United States Patent [19]

Shimoyama et al.

[11] 4,066,479

[45] Jan. 3, 1978

[54] PROCESS FOR PRODUCING NON-DIRECTIONAL ELECTRIC STEEL SHEETS FREE FROM RIDGING

[75] Inventors: Yoshiaki Shimoyama; Kunisuke Miyoshi, both of Kitakyushu, Japan

[73] Assignee: Nippon Steel Corporation, Tokyo, Japan

[21] Appl. No.: 377,012

[22] Filed: July 6, 1973

[30] Foreign Application Priority Data

July 8, 1972 Japan ..... 47-67887

[51] Int. Cl.[2] ..... H01F 1/04

[52] U.S. Cl. ..... 148/111; 148/2; 148/31.55; 148/112

[58] Field of Search ..... 148/2, 3, 110, 111, 148/112, 31.55

[56] References Cited

U.S. PATENT DOCUMENTS

| | | | |
|---|---|---|---|
| 2,378,321 | 6/1945 | Pakkala | 148/110 |
| 3,061,486 | 10/1962 | Jackson | 148/31.55 X |
| 3,203,839 | 8/1965 | Takahashi | 148/113 |
| 3,287,183 | 11/1966 | Taguchi et al. | 148/112 |
| 3,632,456 | 1/1972 | Sakakura et al. | 148/112 |
| 3,764,406 | 10/1973 | Littmann | 148/111 |

FOREIGN PATENT DOCUMENTS

| | | | |
|---|---|---|---|
| 1,220,260 | 1/1971 | United Kingdom | 148/31.55 |
| 870,220 | 6/1961 | United Kingdom | 148/110 |

*Primary Examiner*—Walter R. Satterfield
*Attorney, Agent, or Firm*—Toren, McGeady and Stanger

[57] ABSTRACT

Process for producing non-directional electric steel sheets free from ridging, comprising preparing slabs by continuous casting from molten steel comprising not more than 0.04% C, 1.5 to 4.0% Si, not more than 1.0% Al, the balance being Fe and unavoidable impurities, hot rolling, cold rolling and annealing the slabs, characterized in that the slab is subjected to breaking-down with a reduction rate between 10 to 70% in the sheet thickness direction at a temperature between 1000° and 1300° C, and subsequently the required treatments are done.

3 Claims, No Drawings

PROCESS FOR PRODUCING NON-DIRECTIONAL ELECTRIC STEEL SHEETS FREE FROM RIDGING

The present invention relates to a process for producing non-directional electric steel sheets having a beautiful surface condition free from ridging, and particularly relates to a process for producing non-directional electric steel sheets free from ridging, comprising preparing slabs by continuous casting from molten silicon steel having an appropriately adjusted composition and breaking down the slabs and subsequently hot rolling cold rolling and annealing the slabs.

In recent years, the development of production techniques of non-directional electric steel sheets have been very remarkable, and high-quality electric steel sheets can now be produced thanks to improved methods for adjustment of the molten steel composition, progress in ingot-making techniques and improved production techniques for electric steel sheets.

However, although the introduction of new and improved techniques as above possess the advantage that high-quality electric steel sheets can be obtained, it also has brought in new defects. Thus, in the production of non-directional electric steel sheets, when molten steel having an adjusted composition is cast into slabs by continuous casting and such continuous casting slabs are given various workings, vertical stripes continuous in the rolling direction, or so-called "ridging", appear on the steel sheets.

The vertical stripes or "ridging", deteriorates the surface appearance and commercial value of the sheets, and it is unavoidable that the space factors, etc., are lowered when such defective sheets are formed into layer-built iron cores *m* etc.

As for the causes for the ridging, a columnar structure elongated from the surface layer of the slabs obtained by continuous casting develops, and most of the micro-structure of the slab as cast is occupied by the columnar structure. When a continuous cast slab having such a coarse columnar structure is rolled by conventional means, wrinkle-like vertical stripes sometimes appear continuously in the rolling direction, and particularly in case of steel compositions having no transformation zone, the effect is so remarkable that the vertical stripes remain on the product surface after the cold rolling and the surface appearance is severely damaged.

Various studies on the causes of the ridging have been reported, and the ridging has been attributed partly to the fact that the electrical steel sheet has the tendency that its transformation zone decreases as its silicon content increases so that the possibility of ridging occurence increases.

One of the objects of the present invention is to provide a process for producing non-directional electrical steel sheets having excellent surface conditions free from the ridging as above described.

Other objects and features of the present invention will be clear from the following detailed description.

Any conventional silicon steel composition for the production of non-directional electric steel sheets can be used in the present invention, and the following steel composition range is useful.

C $\leqq$ 0.04% (weight % throughout the specification)
Si 1.5~4.0%
Al $\leqq$ 1.0%
Balance : Fe and unavoidable impurities It is desirable the carbon content in the steel is maintained as low as possible for improvement of the magnetic properties. However, if it is possible to easily reduce the carbon content in a subsequent decarburization step, some amount of carbon may be present and the upper limit of the carbon content is generally defined at 0.04%.

Si is essential for assuring the required magnetic characteristics and not less than 1.5% Si is necessary. On the other hand, considerations should be given so as to avoid Si contents more than 4.0%, because more than 4.0% Si causes cold rolling difficulties, and hence disadvantages for production.

In the present invention, Al is not an essential component, but it is added for the magnetic characteristics and grain adjustment and in this case Al content must be maintained at not more than 1.0%, because Al contents higher than 1.0% causes various disadvantages, such as, deterioration of the hot rolling ability of the steel and difficulties in decarburization.

When Al is added for the above purposes, it is desirable that the Al content is not less than 0.12%. As mentioned above, Al is not always necessary in the present invention.

The molten steel having the above composition is prepared by conventional means, such as, a converter and an electric furnace and cast into slabs of appropriate sizes by continuous casting. In the present invention the continuous casting is not specified, but it may be selected as the case may require.

The continuous cast slab made by any suitable continuous casting means, is heated to a temperature between 1300° C and 100° C, and subjected to breaking-down with a reduction rate not less than 10%. It is necessary that the heating temperature for the breaking-down is within a temperature range of 1000° to 1300° C. When the heating temperature exceeds 1300° C, the columnar structure of the continuous casting slab is rendered coarse and the desired effects of the breaking-down can not be obtained and the objects of the present invention cannot be attained. On the other hand, when the heating temperature is below 1000° C, the breaking-down becomes difficult. It is also necessary that the reduction rate of the breaking-down is not less than 10%, and although the upper limit of the reduction rate is not specifically defined, too large a reduction rate requires heavy and reinforced rolling mill stands with no substantial advantage. On the other hand, with a reduction rate less than 10%, the columnar structure of the continuous casting slab is not broken down and thus the objects of the present invention are not attained.

According to the findings of the present inventors, the reduction rate of 15 to 50% is most preferable.

The continuous casting slab thus broken down is treated by the conventional production steps of non-directional electric steel sheets. Thus, the slab is further reheated and hot rolled into intermediate size hot rolled coils. This hot rolling may be done under conventional rolling conditions; for example, the slab is heated to a temperature above 1000° C and hot rolled. The hot rolled sheet is acid pickled and cold rolled into the final size.

The present invention, however, includes in its scope the procedure that the breaking-down is effected on the hot rolled steel sheet and followed by acid pickling and cold rolling, or that the cold rolling is conducted non-dividedly or dividedly into two or more steps with intermediate annealing therebetween.

The steel sheet thus cold rolled into the final size is finished with a final annealing to give the required magnetic properties. As the case may require, removal of excessive carbon content may be also effected by annealing.

For better understanding of the present invention embodiments of the present invention will be set forth under.

EXAMPLE 1

Molten steel prepared in a converter was treated by vacuum degassing to obtain the following molten steel composition;

C : 0.011%, Si : 2.82%, Al : 0.313%

Balance : Fe

The above molten steel was cast into slabs by continuous casting, and the thus obtained slabs were heated at 1250° C for 4 hours and subjected to breaking-down at a reduction rate between 10 and 40%, to obtain hot rolled slabs. The hot rolled slabs were further heated to 1150° C and hot rolled into an intermediate size, coiled and pre-annealed by box-annealing at 750° C for 15 hours, acid pickled, cold rolled into 0.35mm thickness by a single cold rolling and finished by final annealing.

The results are shown in Table 1 from which it is clear that the ridging appeared in the samples which were not broken down while the samples according to the present invention were all free from the ridging and showed an excellent surface appearance.

Table 1

| Reduction Rate of Breaking-Down | 0 | 10% | 20% | 30% | 40% |
|---|---|---|---|---|---|
| Magnetic W 10/15 | 1.15 W/kg | 1.14 | 1.16 | 1.14 | 1.15 |
| Characteristics $B_{20}$ | 1.51 Wb/m$^2$ | 1.51 | 1.51 | 1.51 | 1.52 |
| Ridging | Appeared | No | No | No | No |
| Irregularity | 18 – 25$\mu$ | No | No | No | No |
| Space Factor % | 97.2 | 99.0 | 98.9 | 98.7 | 99.1 |

EXAMPLE 2

Molten silicon steel of 0.012% C, 2.25% Si, 0.201% Al with the balance being Fe was cast into slabs by continuous casting. The obtained slabs were heated at 1200° C for 4 hours and broken down with a reduction rate of 10 to 40% to obtain hot rolled slabs.

The hot rolled slabs were further heated to 1150° C and hot rolled into an intermediate size, coiled, acid pickled, cold rolled into 0.5mm thickness by a single cold rolling and finished by final annealing.

The results are shown in Table 2, from which it is clear that the samples which were not broken down suffered from the ridging while the samples according to the present invention were all free from the ridging.

Table 2

| Reduction Rate of Breaking-Down | 0 | 10% | 20% | 30% | 40% |
|---|---|---|---|---|---|
| Magnetic W 10/15 | 1.65 W/kg | 1.63 | 1.62 | 1.64 | 1.64 |
| Characteristics $B_{20}$ | 1.54 Wb/m$^2$ | 1.54 | 1.55 | 1.54 | 1.54 |
| Ridging | Appeared | No | No | No | No |
| Irregularity | 15 – 22$\mu$ | No | No | No | No |
| Space Factor % | 97.5 | 99.0 | 99.1 | 99.0 | 99.1 |

What is claimed is:

1. In a process for producing non-directional electric steel sheets free from ridging comprising preparing slabs by continuous casting from molten steel containing not more than 0.04% C, 1.5 to 4.0% Si the balance being Fe and unavoidable impurities, hot rolling, cold rolling and annealing the slabs, the improvement which comprises subjecting the slabs to breaking-down with a reduction rate between 10 and 70% in the sheet thickness direction at a temperature between 1000° – 1300° C prior to the hot rolling.

2. A process according to claim 1 in which the molten steel further contains not more than 1.0% Al.

3. A process according to claim 1 in which the breaking-down is conducted with a reduction rate between 15 and 50%.

* * * * *